United States Patent [19]

Sabelström et al.

[11] Patent Number: 4,557,714

[45] Date of Patent: Dec. 10, 1985

[54] APPARATUS FOR FOLDING A SHEET OF MATERIAL INTO A FOLDER

[75] Inventors: Jan Sabelström; Sture Wiholm, both of Stockholm, Sweden

[73] Assignee: Dynasonic, Johanneshov, Sweden

[21] Appl. No.: 483,642

[22] Filed: Apr. 11, 1983

[30] Foreign Application Priority Data

Apr. 22, 1982 [SE] Sweden ..... 8202537

[51] Int. Cl.[4] ..... B31B 1/56

[52] U.S. Cl. ..... 493/442; 412/900; 493/399

[58] Field of Search ..... 493/178, 179, 397, 398, 493/399, 402, 403, 424, 434, 435, 442, 443, 454; 412/3, 4, 2, 900

[56] References Cited

U.S. PATENT DOCUMENTS

| | | | |
|---|---|---|---|
| 3,127,165 | 3/1964 | Denny et al. | 493/399 |
| 3,389,681 | 6/1968 | Krveger et al. | 493/442 |
| 4,041,849 | 8/1977 | Tsukasaki | 493/442 |
| 4,289,330 | 9/1981 | Wiermanski | 412/900 |

*Primary Examiner*—W. D. Bray

*Attorney, Agent, or Firm*—Dressler, Goldsmith, Shore, Sutker & Milnamow, Ltd.

[57] ABSTRACT

An apparatus is provided for folding a sheet (1) into a folder provided with a spine and at least one cover. In the portion of the sheet forming the spine of the folder after folding, there is applied a bead (2) of binder for binding sheets of paper, inserted in the ready folder, to the inside of the spine. The sheet is advanced with the bead parallel to the advancing direction via a rail (14) guiding the bead to folding and back-up means implemented as rollers (15, 16, 19, 20), for folding the cover side against the inside of the spine along a line situated closely adjacent and parallel to the bead.

4 Claims, 4 Drawing Figures

APPARATUS FOR FOLDING A SHEET OF MATERIAL INTO A FOLDER

DESCRIPTION

1. Technical Field

The present invention relates to an apparatus for folding a sheet of material into a folder having a spine and at least one cover side, a bead of binding agent, applied to the portion of the sheet forming the spine after folding, for joining one or more sheets of paper inserted in the finished folder to the inside of the spine.

2. Background Art

Folders of this kind are already known, and are suitably manufactured by attaching the strip or bead consisting of hot-melt glue between the crease lines defining the spine of the finished folder. Such a folder and apparatus for producing it are illustrated and described in the Swedish Pat. No. 7902871-8. After the crease lines have been made, and the bead applied between them, the folder is taken out of the apparatus and then folded by hand along the crease lines so that the sides forming the jacket or covers are substantially parallel and directly opposite each other.

This manual folding is not only time-consuming, but also results in a folder of poor quality, since uniform manual pressing force cannot be applied to said sides along the entire length of the crease lines.

DISCLOSURE OF INVENTION

One object of the present invention is to provide an apparatus for folding a folder of the kind mentioned in the introduction, said apparatus performing the folding operation very rapidly and giving the folder very good quality.

It is another object of the invention to provide an apparatus particularly suitable for coaction with a machine applying the bead to the folder and possibly also forming crease lines in it.

These objects are attained by the invention being given the characterizing features disclosed in the claims.

PREFERRED EMBODIMENT

The folder which is foled with the aid of the apparatus in accordance with the invention is preferably of the kind illustrated and described in the Swedish Pat. No. 7902871-8. By "folder" in this context is to be understood every kind of folder, booklet, file or the like of paperboard or plastics, intended to protect sheets of paper inserted in the folder, and retain them with the aid of a bead or strip of binder applied to the inside of the folder spine.

Figure 1:
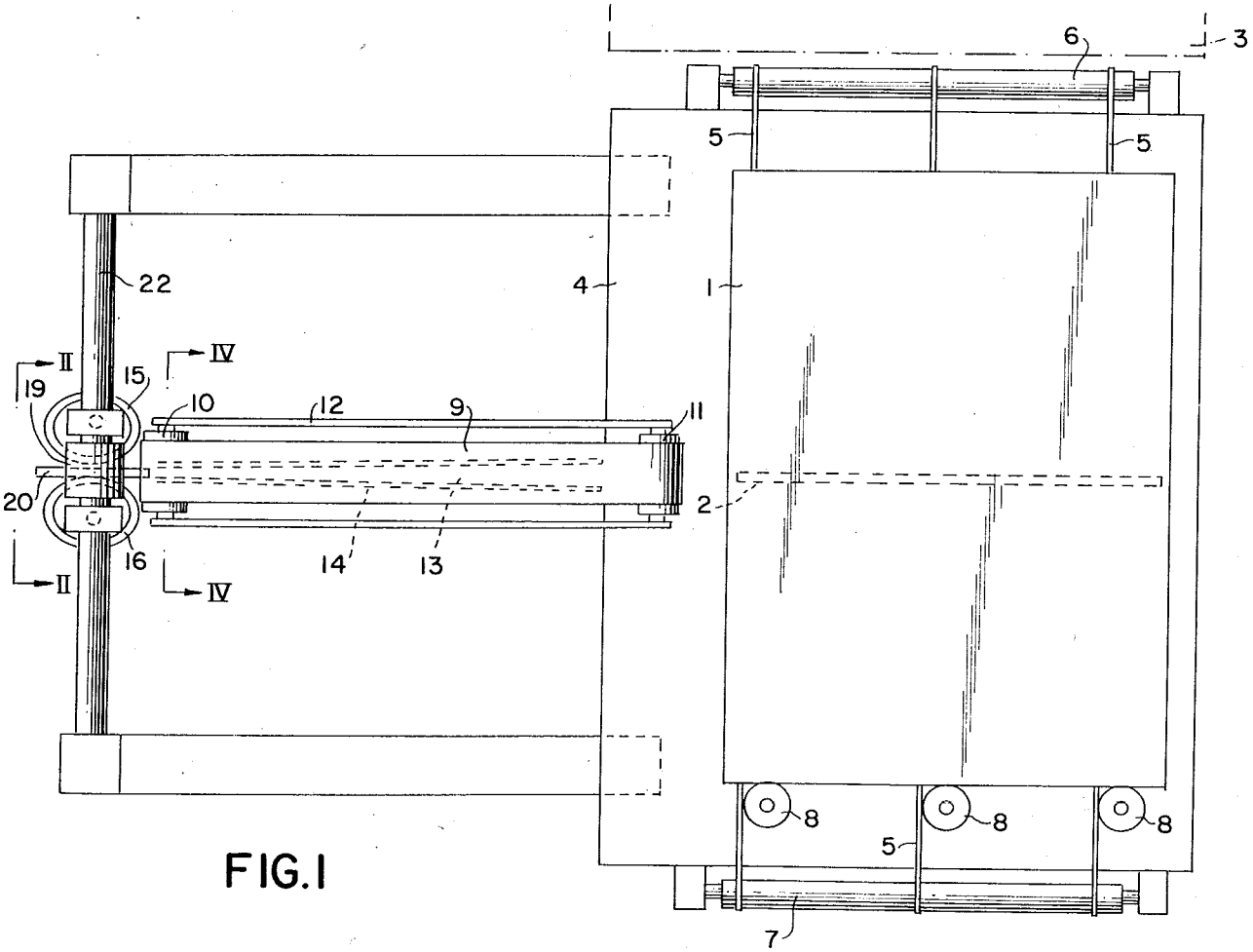
FIG. 1 is a schematic view seen from above of one embodiment of the apparatus in accordance with the invention.

The sheet of material which forms a folder having a spine and two covers after folding is denoted by 1 in FIG. 1. A strip or bead 2 of a binder of the hot-melt glue type, which is in a solid condition at room temperature and which melts when heated in conjunction with the attachment of sheets of paper to the spine of the ready-folded folder, is applied centrally to the sheet of material between two opposing side edges thereof. The bead 2, with a cross section which is rectangular or in the shape of a circle segment has been applied to the sheet 1 in a machine, e.g. of the type described in the cited patent, and which is indicated at 3 in FIG. 1. Simultaneously with the application of the bead 2, crease lines on the sheet on either side of the bead are formed in this machine to facilitate subsequent manual folding of the sheet. In the present case, however, such crease lines are not necessary since they do not notably facilitate folding the sheet with the inventive apparatus, and they have therefore not been shown on the drawings.

The sheet 1 with its attached bead 2 fed out from the machine 3 is transferred via three rubber belts 5 to a table 4 attached to the machine, the upper parts of the belts travel in a direction away from the machine 3 over the table, their return parts travelling under the table. The belts 5 are driven by one of two rolls 6, 7 rotatably attached to the ends of the table 4, and the belts engage and drive rollers 8, which are rotatably mounted on shafts upstanding from the table. When the side edge of the sheet facing away from the machine 3 touches the peripheries of the rollers rotating anti-clockwise in FIG. 1, the sheet 1 is moved by these to the left in FIG. 1 until the sheet is inserted under the lower part of a conveyor belt 9, driven in a suitable manner and carried by a structure 12 provided with two rolls 10 and 11.

The conveyor belt 9 advances the sheet 1 to the left, the bead 2 being inserted in an upwardly open, elongate slot 13 in a guide rail 14, which is attached to the framework of the apparatus and to the table 4. The depth of the slot 13 is greater than the height of the bead 2, and the slot has a width at its right-hand end which is rather larger than that of the bead 2 so that the bead can be inserted therein even if the alignment of the sheet on the table is not exact. The slot tapers continuously and at its left-hand end it has a width just greater than that of the bead.

During the travel of the sheet 1 to the left, sheet portions on either side of the bead 2 engaging against the upper face of the rail 14, the sheet is therefore aligned exactly by coaction between the rail and the bead, and when the bead relinguishes engagement with the rail 14 the bead and thereby the sheet is accurately oriented relative the means, immediately following the rail, for folding the sheet along lines parallel, and close to the bead on either side thereof.

When the left-hand side edge of the sheet 1 has left the belt 9, it comes against the peripheries of two folding rollers 15 and 16, which are freely rotatably mounted on shafts 17 and 18 forming an angle with each other and with the horizontal plane, whereby the portions of said side edge on either side of the bead are bent downwards. During its continued travel and folding, the sheet comes into engagement with a feed roller 19 mounted on a shaft 22 and driven for rotation by an unillustrated driving means. In coaction with the belt 9 this roller 19 further urges the sheet between the folding rollers and back-up means (see FIG. 2 particularly) comprising a roller 20 mounted freely rotatable on a shaft 21 and having a width corresponding to that of the bead. The feed roller 19 urges the portion of the sheet carrying the bead 2 on its opposite side, and thus the bead itself, against the wheel 20, compelling further advance of the sheet for folding between the side surfaces of the wheel and the peripheries immediately adjacent thereto of the folding rollers 15 and 16. The sheet 1, ready-folded into a folder with covers a and b and a spine c is best illustrated in FIG. 3, from which it will also be seen that the folding rollers 15 and 16 may be provided with peripheral horizontal surfaces engaging against the feed roller 19 for rotation of the folding rollers during the folding sequence, with the object of improving the advance of the sheet through the apparatus. If so desired, the wheel 20 may also be rotated by some suitable device. The folding rollers may also be spring-biased for pressing against the wheel 20 and/or the roller 19, inter alia for ensuring constant engagement against them.

Figure 2:
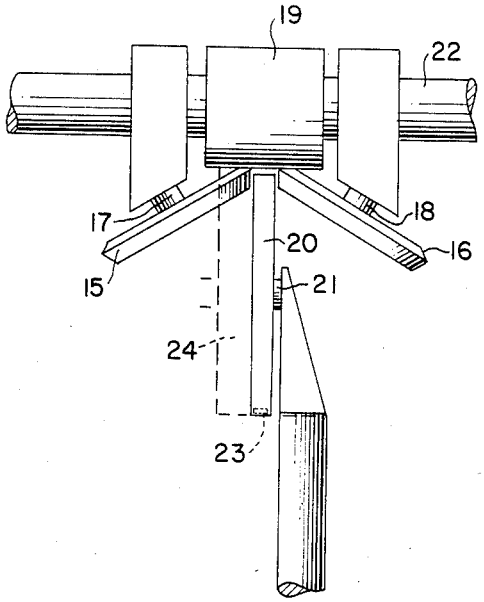
FIG. 2 is an end view seen along the line II—II in FIG. 1.
Figure 3:
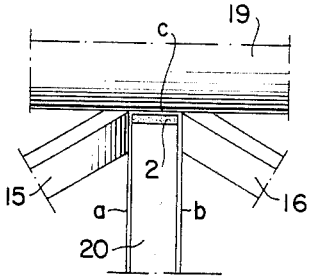
FIG. 3 illustrates details in FIG. 2 to a larger scale.
Figure 4:
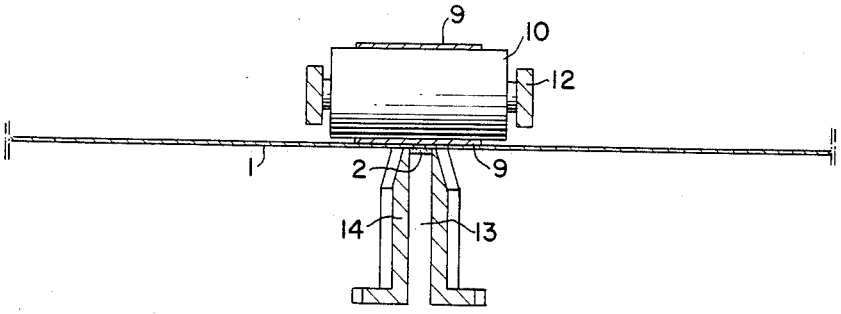
FIG. 4 is a section along the line IV—IV in FIG. 1.

For improving the alignment and guidance of the sheet 1 during the folding process itself, the periphery of the wheel 20 may be provided with an annular groove, the width of which corresponds to that of the bead 2, the bead being inserted in this groove which, as indicated at 23 in FIG. 2, may have a depth either somewhat less than the thickness of the bead, or somewhat greater than this thickness. In the latter case there is obtained the advantage that the sheet 1 will engage against the very thin side walls of the wheel surrounding the groove, said walls defining sharp edges over which the sheet is effectively folded.

Instead of using the wheel 20 as a back-up and guiding means, it may be replaced by the rail 14, which is thereby extended and inserted between the folding rollers 15 and 16.

For adapting the apparatus in accordance with the invention to different bead widths, the wheel 20 and rail 14 are replaceable by wheels and rails of other widths. A wheel 24 adapted to a greater bead width is shown by dashed lines in FIG. 2. In order also to adjust the distance between the folding rollers 15 and 16 to other bead widths, the support means of at least one of these rollers has been adapted displaceable on the shaft 22 and may be locked in any desired position relative the other roller.

When the sheets 1 folded into folders leave the folding apparatus, they are counted by a counter (not shown) disposed in association with the wheel 20 and stacked into batches, the batches being discharged from the apparatus when they contain a predetermined number of folders.

Even if only a few embodiments of the invention have been described above and illustrated on the drawings, it should be understood that the invention is not limited to these. Thus, the rail 14 may not be provided with the groove 13, instead being implemented as a thin guide strip against which one side edge of the bead 2 engages during the travel of the sheet 1 towards the folding means, or may be replaced by some other suitable means exactly guiding the bead into the folding means, the bead always being exactly oriented on the sheet. The invention is thus solely restricted by what is disclosed in the claims.

I claim:

1. Apparatus for folding a sheet of material into a folder having a spine and at least one cover side and a bead of binding agent secured to a central portion of said sheet of material that forms the spine of a folder when the sheet is folded into a folder, means for advancing the sheet while maintaining the bead parallel to the advancing direction, means for folding the sheet of material along lines adjacent and parallel to the bead to form covers of the folder, and backup means disposed adjacent said folding means which provides support for said spine and against which the sheet of material is folded during the folding action.

2. Apparatus as claimed in claim 1 wherein said backup means consists of a rotatable roller having a width substantially as great as said bead and positioned to support said bead during the folding action.

3. Apparatus as claimed in claim 2 in which said folding means includes rotatable roller means disposed adjacent said backup means.

4. Apparatus for folding a sheet of material into a folder having a spine and at least one cover side and a bead of binding agent secured to a central portion of said sheet of material that forms the spine of a folder when the sheet is folded into a folder, means for advancing the sheet while maintaining the bead parallel to the advancing direction, said means for maintaining the bead parallel to the advancing direction of the sheet comprising a rail defining a longitudinal slot which receives said bead, said slot having a continously tapering cross section in the advancing direction of the sheet, and means for folding the sheet of material along lines adjacent and parallel to the bead to form covers of the folder.

* * * * *